US006131758A

United States Patent [19]

Callahan et al.

[11] Patent Number: 6,131,758

[45] Date of Patent: Oct. 17, 2000

[54] BUS PAN COVER

[76] Inventors: John S. Callahan; John F. Callahan, both of 4079 Calle Platino, Oceanside, Calif. 92056

[21] Appl. No.: 09/348,100

[22] Filed: Jul. 6, 1999

[51] Int. Cl.[7] ..... B65D 25/00

[52] U.S. Cl. ..... 220/314; 220/23.83; 220/676

[58] Field of Search ..... 220/770, 676, 220/23.83, 23.86, 23.91, 314

[56] References Cited

U.S. PATENT DOCUMENTS

| | | | |
|---|---|---|---|
| 1,118,738 | 11/1914 | Carroll | 220/676 |
| 2,297,945 | 10/1942 | Cornelius | 220/239.1 |
| 2,944,694 | 7/1960 | Kinsey | 220/23.83 X |
| 4,819,822 | 4/1989 | Box | 220/676 X |
| 5,285,900 | 2/1994 | Swingler | 220/676 X |
| 5,772,066 | 6/1998 | Reynolds | 220/23.83 X |

*Primary Examiner*—Steven Pollard
*Attorney, Agent, or Firm*—Steins & Associates

[57] ABSTRACT

A Bus Pan Cover is disclosed. Also disclosed is a cover that includes a top and a plurality of sides to form a cover for a conventional bus pan. The cover further includes a pass-through aperture formed in the top such that the user might access the bus pan for passing dishes and the like there-through. The preferred cover includes one or more handle apertures formed in the sides such that the handles formed in a standard bus pan line up to provide access thereto through the handle apertures so that the cover and bus pan might be picked up in a single motion. Finally, the cover might furthermore include decorative or informative display panels formed on the sides to display indicia or otherwise improve the aesthetic qualities of the bus pan and cover.

12 Claims, 5 Drawing Sheets

BUS PAN COVER

BACKGROUND OF THE INVENTION

1. Field of the Invention

This invention relates generally to food service apparatus, and more specifically to a bus pan cover.

2. Description of Related Art

FIG. 1 is a perspective view of a conventional bus pan. A conventional bus pan 10 is of consistent size, and generally rectangular shape, defining an outer surface 12 and an inner surface 14, within which articles might be placed. Around the upper edge of the outer surface 12 is formed a rim 16, which facilitates the stacking of a plurality of bus pans 10 in addition to the rim 16 providing a hand hold for carrying. Furthermore, a pair of handles 18, are typically formed in opposing ends of the rim 16. The handles 18 are generally reinforced sections of the rim 16 to provide a more structurally sound grasping location. As described earlier, bus pan 10 has an inner surface 14, which defines a chamber 20. The chamber 20, is accessed through the bus pan aperture 22 formed by the opening in the rim 16 when in use. Therefore, articles are typically placed in the chamber 20 through the bus pan aperture 22, after which the bus pan 10 is grasped by the handles 18 and carried away.

If we now turn to FIG. 2, we can discuss how the bus pan 10 is typically used in the banquet and/or restaurant environment from which it gets its name. FIG. 2 is a depiction of the bus pan of FIG. 1 showing how dirty dishes and the like are placed therein. As can be seen here, a plurality of dirty dishes 24 have been placed into the chamber 20 through the bus pan aperture 22. Conventionally, this is done by a bus person whose job it is to travel from table to table after the patrons have left, in order to clear their dirty dishes 24. After filling the bus pan 10 with dirty dishes 24, the bus person will typically transport the full bus pan 10 to the kitchen for processing. While inside the kitchen, the bus person will typically obtain an empty, clean bus pan 10, which he or she will take back to the dining area. Many times these empty bus pans 10 are left in the dining area so that they are easily obtainable when a table needs to be cleared.

In an alternative scenario, such as the self-service buffet, people generally bus their own tables, at least part of the time. In such situations, the bus pans 10 are left in a variety of locations around the dining room so that it is convenient for the patrons to place their dirty dishes therein, while heading back to the buffet line to get more food. The problem with these prior bus pans is that the pans have virtually no aesthetic value, but are simply designed for their utilitarian purpose. As such, when they are left (as is commonly done) out in plain sight in a dining area, they reduce the quality of the overall dining experience for the patrons. What is needed is a method and apparatus for improving the aesthetic appearance of the conventional bus pans 10 without reducing their functionality.

SUMMARY OF THE INVENTION

In light of the aforementioned problems associated with the prior devices, it is an object of the present invention to provide a Bus Pan Cover. The preferred cover will include a top and sides to form a cover for a conventional bus pan. The cover should further include a pass-through aperture formed in the top such that the user might access the bus pan for passing dishes and the like therethrough. It is a further object that the cover include decorative or informative display panels formed on the sides. It is yet another object that the cover include one or more handle apertures formed in the sides such that the handles formed in a standard bus pan line up to provide access thereto through the handle apertures so that the cover and bus pan might be picked up in a single motion.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Bus Pan Cover.

Figure 3:
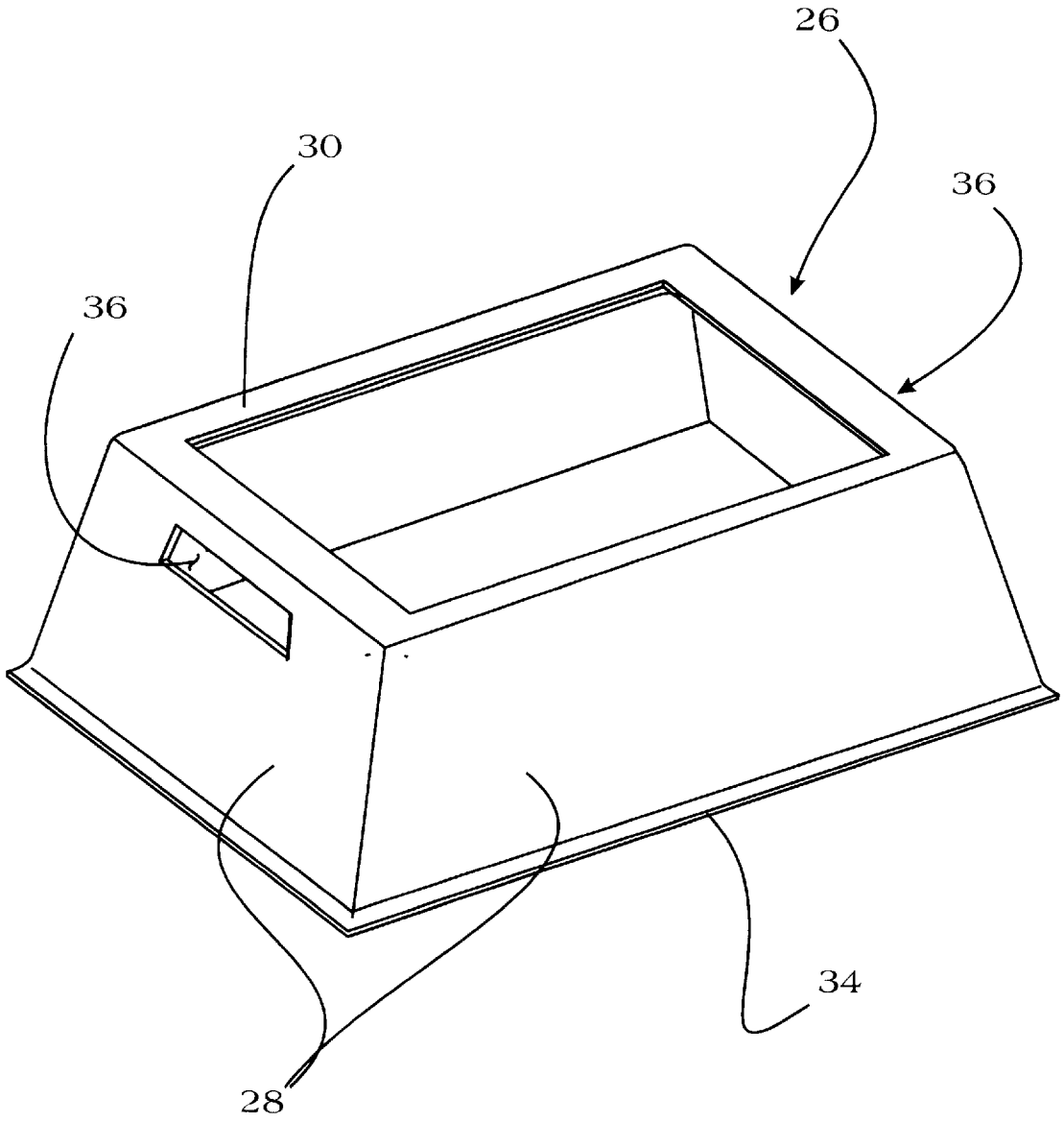
FIG. 3 is a perspective view of a preferred bus pan cover of the present invention.

The present invention can best be understood by initial consideration of FIG. 3. FIG. 3 is a perspective view of a preferred bus pan cover 26 of the present invention. As can be seen, the bus pan cover 26 defines a plurality of side members 28 and a top member 30, within which is formed a pass-through aperture 32. The side members 28 terminate on their lower portion in a bottom edge 34, which extends around the lower circumference of the bus pan cover 26. Furthermore, preferably a pair of handle apertures 36 will be formed in opposing side members 28 of the bus pan cover 26. The preferred cover 26 is made from durable material such as plastic, and/or plastic combined with other materials such as wood or metal. In any case, the preferred bus pan cover 26 should provide an aesthetically pleasing outer surface on the side members 28 such that they might be conformed to generally match the decor of a dining area. If we now turn to FIG. 4, we can see how this bus pan cover 26 is preferably put to use.

Figure 1:
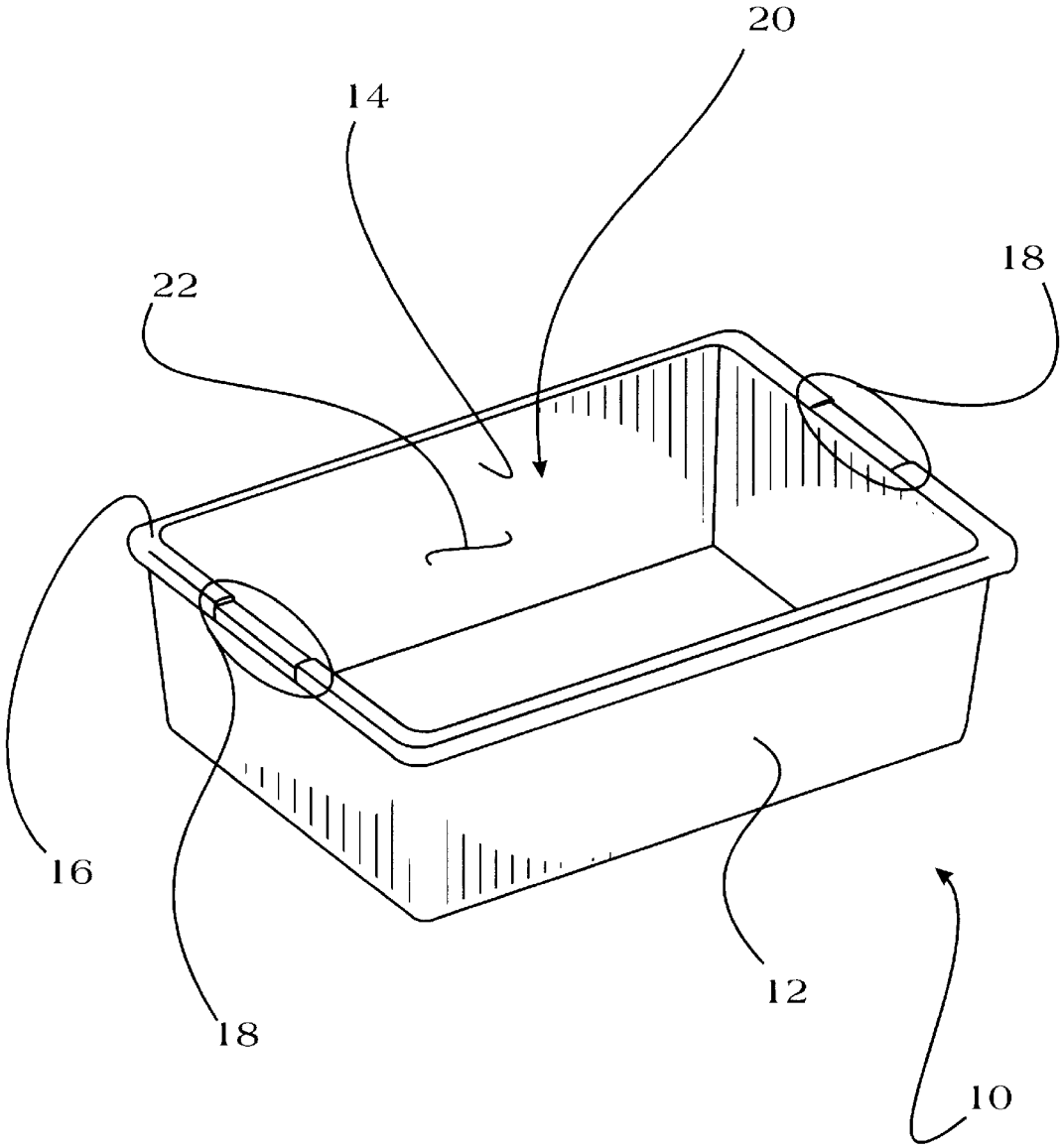
PRIOR ART FIGURE 1
FIG. 1 is a perspective view of a conventional bus pan.
Figure 2:
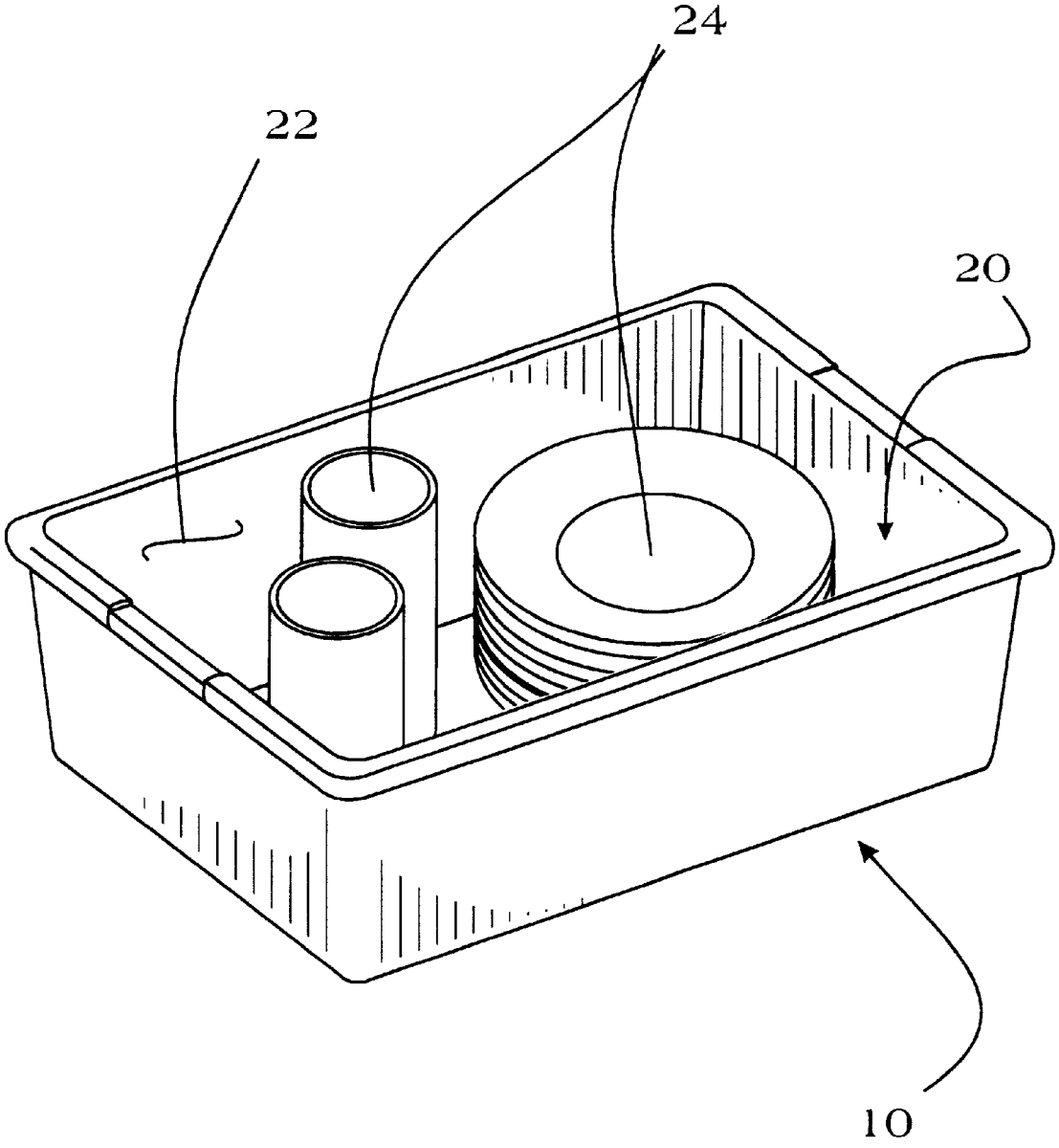
PRIOR ART FIGURE 2
FIG. 2 is a depiction of the bus pan of FIG. 1 showing how dirty dishes and the like are placed therein.
Figure 4:
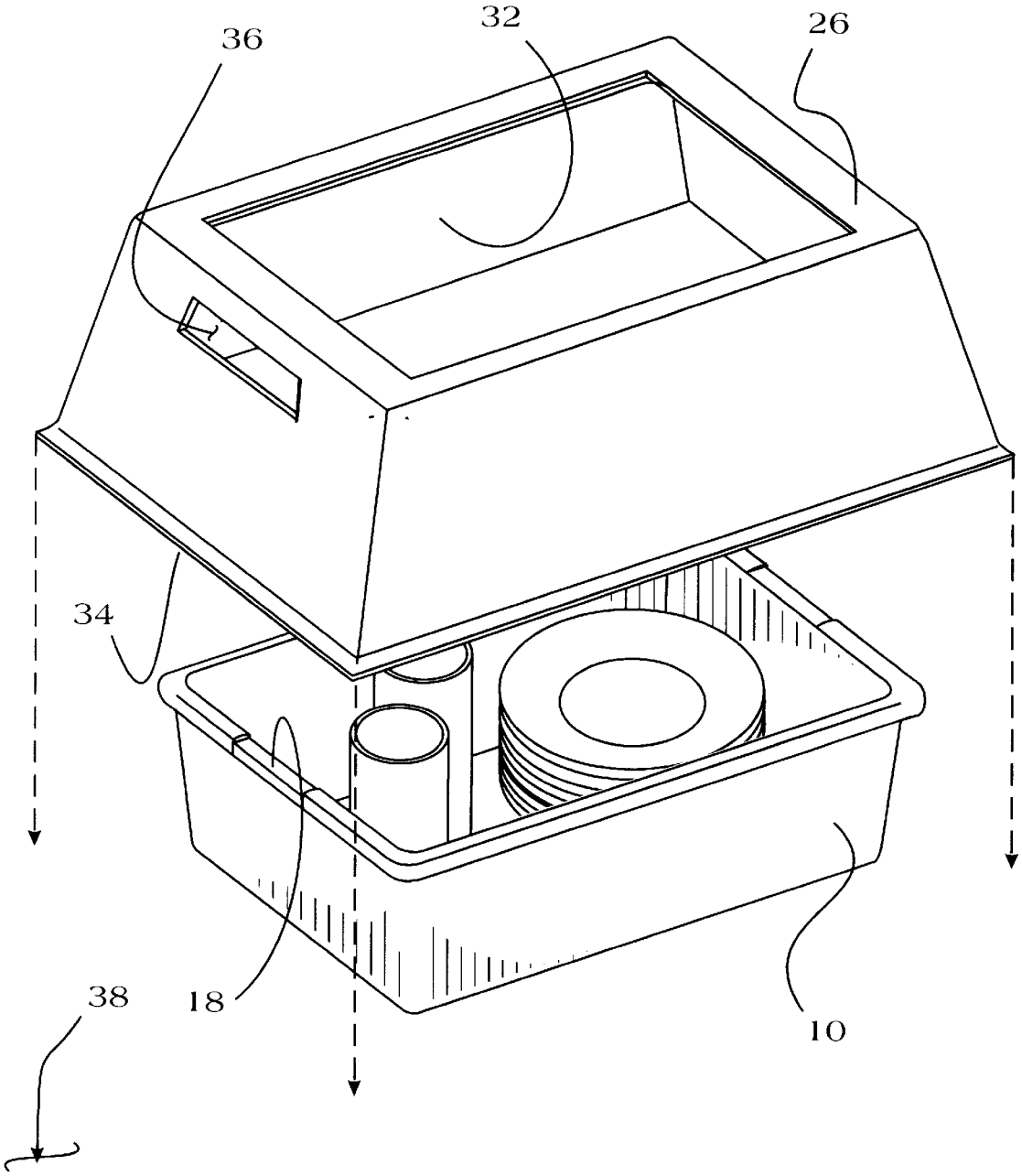
FIG. 4 is an exploded perspective view of the bus pan cover of FIG. 3 as it would be placed over a conventional bus pan of FIGS. 1 and 2.

FIG. 4 is an exploded perspective view of the bus pan cover 26 of FIG. 3 as it would be placed over a conventional bus pan 10 of FIGS. 1 and 2. FIG. 4 depicts how the preferred bus pan cover 26 can be used with the conventional bus pan 10. As can be seen, the bus pan cover 26 is formed such that it fits easily over the outer surface of the bus pan 10, after which the bus pan aperture 22 aligns perfectly with the pass-through aperture 32 formed within the bus pan cover 26. Furthermore, the handle 18 in the bus pan 10 will align with the handle aperture 36 formed in the bus pan cover 26 so that once the bus pan cover 26 is placed over the bus pan 10, the user might access the handle 18 through the handle aperture 36. As such, the bottom edge 34 of the bus pan cover 26 will rest on whatever surface 38 upon which the bus pan 10 is resting, such that the aforementioned alignments are perfect. In practice therefore, the bus person will take a clean bus pan 10 and place a bus pan cover 26 thereover before entering the dining area. Once the bus pan 10 is fill with dirty dishes (see FIG. 1), he or she will take the assembly out to the kitchen for processing. While in the kitchen, the bus person need simply lift the bus pan cover 26 off the bus pan 10 containing the dirty dishes, and then place the bus pan cover 26 over a empty bus pan 10 before reentering the dining area. In this way, the restaurant need only obtain a few bus pan covers 26 in order to handle a large volume of dirty dishes. Furthermore, there will be no need to replace the existing bus pans 10 in order to effect this dramatic aesthetic improvement. It should be understood that an application for the cover 26 might be to "dress up" a bus pan 10 so that it might be used for the presentation of articles, such as ice or iced products, thereby adding much more utility to the conventional bus pan 10. If we now turn to FIG. 5, we can see how the bus pan cover 26 and bus pan 10 appear while assembled together.

Figure 5:
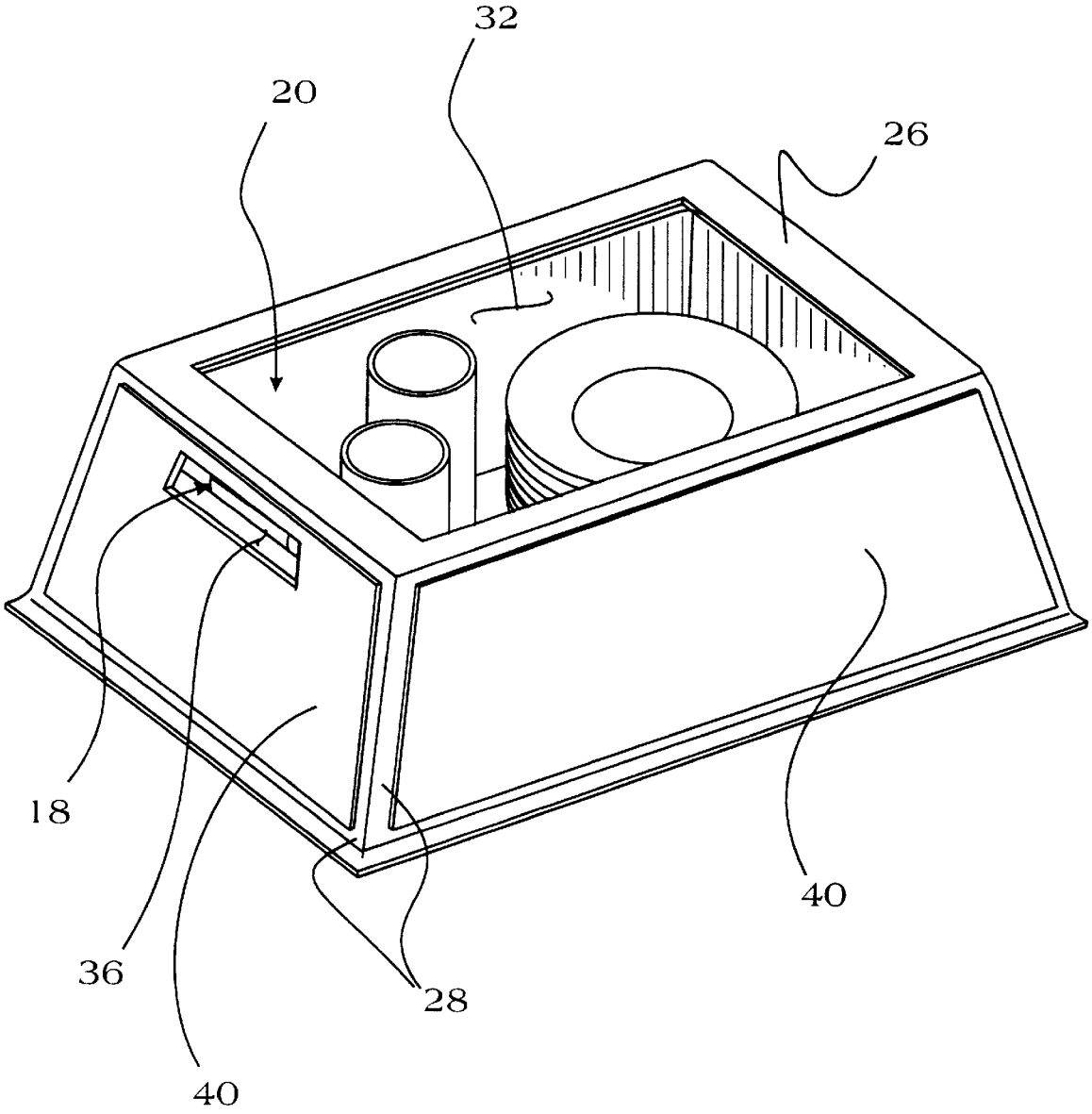
FIG. 5 is a perspective view of the bus pan cover of FIGS. 3 and 4 as it rests covering the conventional bus pan.

FIG. 5 is a perspective view of the bus pan cover of FIGS. 3 and 4 as it rests covering the conventional bus pan. As can be seen, the chamber 20 (of the bus pan 10) can be easily reached through the pass-through aperture 32. Furthermore, the handles 18 (of the bus pan 10) can be reached through the handle apertures 36. In this alternative embodiment, a plurality of display panels 40 have been positioned on the side members 28. The display panels 40 might be made from plastic, wood or simulated wood, or metal, or furthermore might provide locations to put the restaurant's name, or even advertising materials or other indicia such that messages for special events or other information might be removably or permanently inscribed on the display panels 40. Furthermore, the display panels 40 might be either formed within side members 28, or they may be attached to side members 28, or alternatively they might be removably attached to side members 28, such that different display panels 40 might be attached and detached, depending upon the aesthetic desires of the restaurant owner.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cover for bus pans and the like, said bus pans including a pair of handles and further define a chamber for placing items therein, comprising:

a top member defined by a pass-through aperture;

a plurality of side members extending downwardly from said top member, said top and side members configured cooperatively with a bus pan such that said cover can be placed over a bus pan to cover the bus pan; and at least one handle aperture, each said handle aperture formed in one said side member such that when said cover is placed over the bus pan, said handle aperture is in alignment with said handle.

2. The cover of claim 1, wherein said pass-through aperture is in alignment with said chamber when said cover is place over to cover said bus pan.

3. The cover of claim 2, wherein each said side member is further defined by at least one display panel.

4. The cover of claim 3, wherein said display panels are formed from wood-tone plastic.

5. The cover of claim 3, wherein said display panels are configured to display indicia thereon.

6. A bus pan cover, said bus pans defined by a pair of opposing handles located on a rim, said rim defining a bus pan aperture, said bus pan aperture allowing access to a chamber formed within said bus pan, comprising:

a top member defined by a pass-through aperture;

a plurality of side members extending downwardly from said top member, said top and side members configured cooperatively with a bus pan such that said cover can be placed over a bus pan to cover the bus pan; and at least one handle aperture, each said handle aperture formed in one said side member such that when said cover is placed over the bus pan, said handle aperture is in alignment with said handle.

7. The cover of claim 6, wherein said pass-through aperture is in alignment with said chamber when said cover is place over to cover said bus pan.

8. The cover of claim 7, wherein each said side member is further defined by at least one display panel.

9. The cover of claim 8, wherein said display panels are formed from wood-tone plastic.

10. The cover of claim 8, wherein said display panels are configured to display indicia thereon.

11. A process for improving the aesthetic appearance of a bus tub, said bus tubs include a pair of handles and further define a chamber for placing items therein, comprising the steps of:

placing an aesthetically pleasing cover having a pass-through aperture formed in it over the bus tub; and aligning a pair of handle apertures formed within a plurality of side members extending downwardly from a top member through which is formed said pass-through aperture, with said handles.

12. The process of claim 11, further defined by the step of displaying material of decorative quality on display surfaces found on said side members.

* * * * *